United States Patent [19]

Nishida et al.

[11] 4,436,594

[45] Mar. 13, 1984

[54] METHOD OF TREATING THE SURFACE OF A METAL CONTAINER

[75] Inventors: Yoshiaki Nishida, Kitakyushu; Shunji Yano, Sagamihara; Tadahiro Masuyama, Ibaragi, all of Japan

[73] Assignee: Daiwa Can Company, Limited, Tokyo, Japan

[21] Appl. No.: 264,539

[22] Filed: May 18, 1981

[51] Int. Cl.[3] ..... C25D 5/36; C25D 5/44; C25D 7/04; C25D 13/20

[52] U.S. Cl. ..... 204/33; 204/34; 204/181 R; 204/181 C

[58] Field of Search ..... 204/32 R, 33, 34, 181 R, 204/181 C

[56] References Cited

U.S. PATENT DOCUMENTS

| | | | |
|---|---|---|---|
| 3,262,460 | 7/1966 | Huddle et al. | 134/72 |
| 3,952,698 | 4/1976 | Beyer et al. | 118/314 |
| 4,094,760 | 6/1978 | Smith et al. | 204/181 R |
| 4,101,386 | 7/1978 | Dotzer et al. | 204/32 R |
| 4,102,350 | 7/1978 | Chelton et al. | 134/130 |
| 4,137,131 | 1/1979 | Donaghy | 204/32 R |
| 4,152,173 | 5/1979 | Jackson et al. | 134/10 |
| 4,175,018 | 11/1979 | Gocesa | 204/181 T |
| 4,246,088 | 1/1981 | Murphy et al. | 204/181 R |

FOREIGN PATENT DOCUMENTS 1498795 1/1978 United Kingdom .

*Primary Examiner*—Howard S. Williams

*Attorney, Agent, or Firm*—Wenderoth, Lind & Ponack

[57] ABSTRACT

Both the inner and outer surfaces of a metal container are degreased with an organic solvent, and then without being subjected to cleaning, are provided with a surface layer having particular properties by electrolysis, or are electrophoretically treated to provide a coating.

3 Claims, 2 Drawing Figures

METHOD OF TREATING THE SURFACE OF A METAL CONTAINER

FIELD OF THE INVENTION

This invention relates to a method of treating both inner and outer surfaces of a metal container.

BACKGROUND OF THE INVENTION

Drawn and ironed (D&L) cans are currently in wide use as containers for beverages. These D&I cans are manufactured by the following procedure: an aluminum or tinplate workpiece is blanked out, drawn and ironed, and after the open end portion is trimmed and otherwise worked, the can is transported on a net conveyor with the open end facing down while it is sprayed with an upward and downward shower of aqueous degreasing agent for removing the coolant (lubricant) that has been deposited on the surfaces of the can during ironing and with an upward and downward shower of aqueous chemical to provide a corrosion-resistant surface and improved paint adhesion. These procedures of degreasing and chemical surface treatment consist of the following steps: (preliminary decreasing)→degreasing→blowing off→washing with water→blowing off→chemical surface treatment→blowing off→washing with water→blowing off→washing with deionized water→blowing off→drying. The "blowing off" means blowing the liquid treating agent off the bottom of the can with compressed air. After drying, the can is forwarded to coating and printing steps.

The treating method outlined above is employed in many commercial can making factories. A compact apparatus for surface treatment that achieves degreasing in a shorter period of time is described in Japanese Laid-open Patent Publication No. 158489/75 (corresponding to U.S. Pat. No. 4,026,311). A side elevational view of the apparatus is represented in the accompanying FIG. 1. The apparatus comprises a base plate 1, a cylindrical core 2 extending vertically from the base plate 1, and a shell 3 extending vertically from the base plate 1 and being positioned concentrically with the core 2 to cover it. The apparatus also includes a first channel 4 for discharging or introducing the treating fluid which penetrates the base plate 1 and also penetrates the core 2 along its central axis, a second channel 6 for introducing or discharging the treating fluid that penetrates the center of the top wall 5 of the shell 3, and a plurality of projecting fins 8 that are formed around the lower end 7 of the core 2 at a suitable interval and which fit the open end 20 of the can to be treated. The base plate 1, core 2 and the shell 3 form a cavity 15. In FIG. 1, the can is shown generally by the phantom line A as if it were put in the cavity 15. The shape produced by the inner surface 9 of the can and the outer surface 10 of the core 2 is similar to that produced by the outer surface 11 of the can and the inner surface 12 of the shell 3, and the gap l between the surfaces 9 and 10 as well as the gap l' between the surfaces 11 and 12 is very small.

The inner and outer surfaces of the can are degreased in the apparatus of FIG. 1 as follows: first, the can A is positioned in such a manner that the inner surface of the open end 20 of the can fits the projecting fins 8 and the flat portion 21 of the open end is in contact with the upper surface 13 of the base plate; then, a degreasing fluid made of an organic solvent (e.g. trichloroethylene) is poured through the second channel 6; the fluid flows down the gap l' between the outer surface 11 of the can and the inner surface 12 of the shell 3, goes through slots 14 formed between each fin 8, goes up the gap l between the inner surface 9 of the can and the outer surface 10 of the core 2, and goes out of the apparatus through the first channel 4. The above sequence enables both inner and outer surfaces 9 and 11 of the can to be degreased. Subsequently, the remaining degreasing fluid is removed by the following procedure: rinsing water is poured through the second channel 6; the water flows down the gap l' between the outer surface 11 of the can and the inner surface 12 of the shell 3, goes through the slots 14, goes up the gap l between the inner surface 9 of the can and the outer surface 10 of the core 2, and goes out of the apparatus through the first channel 4. This sequence enables the degreasing fluid to be washed away from both inner and outer surfaces 9 and 11 of the can. Subsequently, heated air is supplied into the cavity through the first channel 4 to dry both the inner and outer surfaces 9 and 11 of the can. The above degreasing and drying procedures are followed by the chemical surface treatment which consists, as described before, of application of a chemical→blowing off→washing with water→blowing off→washing with deionized water→blowing off→drying. We presume the advantage of degreasing the can with trichloroethylene or other organic solvents in the small cavity in the apparatus of FIG. 1 are that degreasing can be accomplished in a shorter period with an apparatus smaller in size than the method of degreasing cans that are being transported on a net conveyor. As already mentioned, the degreased can is subjected to chemical surface treatment or coating procedures to form a corrosion-resistant protective layer, and the industry has need for further reducing the overall period of surface treatments and the energy spent in the treatments.

SUMMARY OF THE INVENTION

This invention provides a method for treating the surface of a metal container that eliminates the use of a net conveyor and which uses an organic solvent as a degreasing agent, and the invention aims at reducing the overall period of surface treatments with a resulting saving in energy consumption. More specifically, this invention provides a method wherein the inner and outer surfaces of a metal container are degreased with an organic solvent, and then without being subjected to cleaning and drying steps, are provided with a surface layer having particular properties by electrolysis, or are electrophoretically treated to form a coating. According to this invention, effective coating or formation of a surface layer having particular properties can be achieved in a short period without losing the advantage of degreasing with an organic solvent (i.e. faster degreasing than when an aqueous degreasing agent is used), and in addition, the degreasing step need not be followed by cleaning with water or drying with heated air. In consequence, this invention is able to manufacture metal containers of better quality at lower cost than the conventional technique.

DETAILED DESCRIPTION OF PREFERRED EMBODIMENTS

Before going into details of preferred embodiments of this invention, we now describe the attempts we made to accomplish this invention. First, we degreased a can with an organic solvent using the apparatus described in Japanese Laid-open Patent Publication No. 158489/75, and without rinsing and drying the can, we took the can out of the apparatus and transported it on a net conveyor with the open end facing down while it was subjected to the following sequence of treatments: (a) surface treatment with an aqueous chemical→(b) blowing off→(c) rinsing with water→(d) blowing off→(a) rinsing with deionized water→(f) blowing off→(g) drying. But the above method had the following defects: the degreased surface of the can was so low in hydrophilicity that the subsequent surface treatment with an aqueous chemical took longer than did the conventional method wherein the can was subjected to degreasing and subsequent chemical surface treatment while it was transported on a net conveyor, and the result of chemical surface treatment was not as good as expected.

To reduce the overall period from degreasing to coating, we replaced the steps (a) to (f) by a coating step using a water-soluble or water-dispersible paint that is getting increased attention of the industry because of its minimum potential pollution hazard, but it turned out that the adhesion of the resulting coating to the surface of the can was too low to meet practical requirements.

Figure 1:
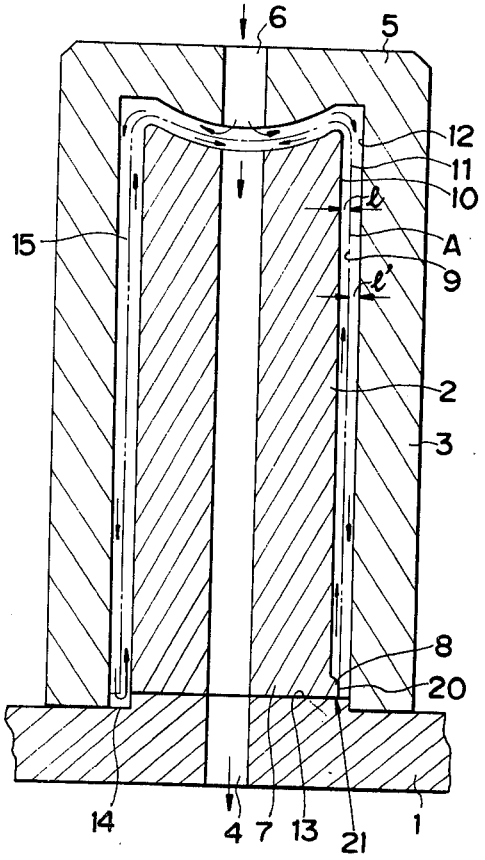
FIG. 1 is a side elevational view of an apparatus for treating the surface of a metal container according to the conventional method.
Figure 2:
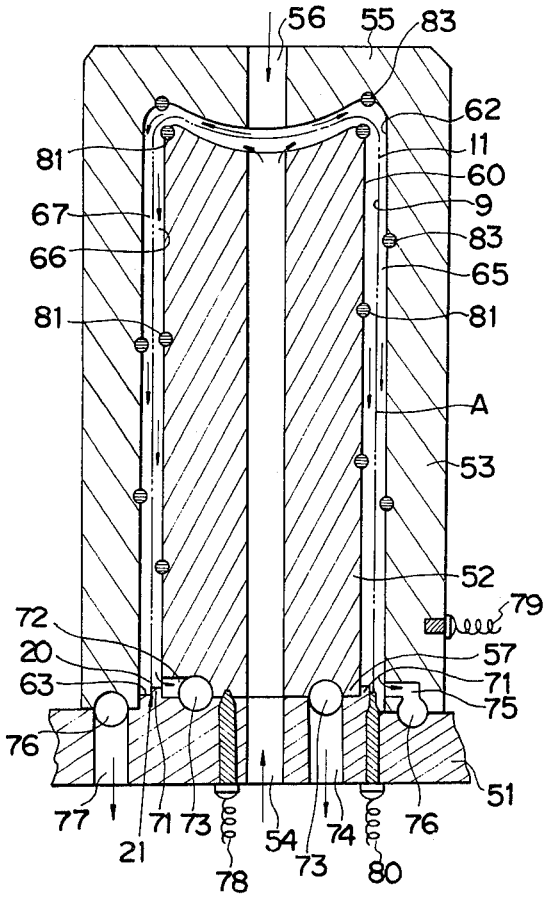
FIG. 2 is a side elevational view of an apparatus for treating the surface of a metal container according to the method of this invention.

These attempts were the basis of this invention, preferred embodiments of which are described below. A first embodiment wherein the degreased can is immediately (i.e. without rinsing and drying) subjected to a surface treatment by electrolysis is described hereunder by reference to the accompanying drawings. FIG. 2 shows a base plate 51, a core 52, shell 53, a first channel 54 for treating fluid, the top wall 55 of the shell, a second channel 56 for treating fluid, the lower end 57 of the core 52, the outer surface 60 of the core 52, the inner surface 62 of the shell 53, the upper surface 63 of the base plate and a cavity 65, and these portions or components are equivalent to those of the apparatus of FIG. 1 which are identified by 1, 2, 3, 4, 5, 6, 7, 10, 12, 13, and 15. Since the apparatus of FIG. 2 is also used in electrolysis, the base plate 51 must be made of an electrical insulator or its surfce must be electrically insulated. In FIG. 2, the can to be treated, the inner and outer surfaces of the can, the open end of the can, and the flat portion of the open end are identified as A, 9, 11, 20 and 21 as in FIG. 1.

The apparatus of FIG. 2 also has electrically insulating projections 81 that are formed at selected points of the outer surface of the core 52 to prevent the inner surface 9 of the can from contacting the outer surface 60 of the core 52, an annular insulating projection 71 formed around the lower end 57 of the core 52 (said projection 71 providing intimate contact with the inner surface of the open end 20 of the can to completely subdivide the cavity 65 into an inner chamber 66 and an outer chamber 67), and insulating projections 83 formed on the inner surface 62 of the shell 53. The apparatus further includes a plurality of inner horizontal discharge ducts 72 formed around the lower part 57 of the core 52 at a given interval that communicate with the inner chamber 66 and which extend radially toward the center of the core 52, an inner annular discharge duct 73 that communicates with the inner horizontal discharge ducts 72 and which is concentric with the core 52, and an inner vertical discharge duct 74 that communicates with the inner annular discharge duct 73 and which penetrates the base plate 51 to communicate with the outside of the plate, the discharge ducts 72, 73 and 74 being collectively referred to as an inner duct system through which the treating fluid is discharged. The apparatus also has a plurality of outer horizontal discharge ducts 75 formed around the lower part of the shell 53 at a given interval that communicate with the outer chamber 67 and which extend radially outward, an outer annular discharge duct 76 that communicates with the outer horizontal discharge ducts 75 and which is concentric with the shell 53, and an outer vertical discharge duct 77 that communicates with the outer annular discharge duct 76 and which penetrates the base plate 51 to communicate with the outside of the plate, the discharge ducts 75, 76 and 77 being collectively referred to as an outer duct system through which the treating fluid is discharged. The apparatus is further equipped with an electrode 78 that is covered with an electrical insulator and from which a current is applied through the core 52, an electrode 79 from which current is applied through the shell 53, and an electrode 80 that is in contact with the flat portion 21 of the open end of the can A and from which a current is applied through the can.

A fluid for treating the outer surface of the can that enters the cavity 65 through the second channel 56 flows down the gap between the outer surface 11 of the can and the inner surface 62 of the shell 53 and is discharged through the outer discharge duct system comprising the ducts 75, 76 and 77. A fluid for treating the inner surface of the can that enters the cavity 65 through the first channel 54 goes up, flows down the gap between the inner surface 9 of the can and the outer surface 60 of the core 52 and is discharged through the inner discharge duct system comprising the ducts 72, 73 and 74. While the fluids are within the gap between the outer surface 11 of the can A and the inner surface 62 of the shell 53, and in the gap between the inner surface 9 of the can and the outer surface 60 of the core 52, a current is impressed at each electrode to provide both the inner and outer surfaces of the can with a desired surface layer by electrolysis.

In the apparatus of FIG. 2, the contact between the inner surface of the open end 20 of the can and the annular projection 71 is close enough to prevent the fluid for treating the outer surface of the can from being intermingled with the fluid for treating the inner surface. This permits the inner and outer surfaces of the can to be treated with fluids having different concentrations and compositions. As a further advantage, the area of the can surface that must be treated by a given treating fluid is half that required in the apparatus of FIG. 1, so the fluid is less diluted around the inlet and outlet. This means increased treating efficiency, hence a shortened treatment period.

The apparatus for treating the surface of the can by electrolysis according to this invention is not limited to the embodiment shown in FIG. 2. The cavity 65 may be completely divided into two chambers by a magnet formed on the top 63 of the base plate 51 that attracts the flat portion 21 of the open end 20 of the can into close contact with said top. In this case, the annular projection 71 has only the function of preventing the inner surface 9 of the can from contacting the outer surface 60 of the core 52 and it does not serve as means for completely dividing the cavity into two chambers. Alternatively, an annular projection that contacts the outside surface of the open end 20 of the can may be used as means to completely separate the cavity into two chambers.

The position or shape of each electrode is not limited to that illustrated in FIG. 2. A wire electrode may be fitted in a spiral groove made in the outer surface 60 of the core 52 and the inner surface 62 of the shell 53. The groove causes turbulence in the descending or ascending flow of the treating fluid to achieve more effective electrolysis or electrophoretic coating.

The cavity 65 need not be completely divided into two chambers. Instead, the apparatus of FIG. 1 may be provided with the respective electrodes as in FIG. 2 or in the manner described above. The inner and outer discharge duct systems are also not limited to the arrangement shown in FIG. 2. Discharge ducts sloping downward, or and any other arrangement, may be used so long as there is no residual treating fluid in the cavity. The outer surface 60 of the core 52 and the inner surface 62 of the shell 53 preferably form a shape substantially similar to that of the can. The shell 53 may be subdivided into a cylindrical portion and a lid (top wall). The annular insulating projection 71 may be formed integral with the core 52 (on the condition that the core be made of an electrical insulator) or integral with the base plate 51. Alternatively, the projection 71 may be formed integral with the shell 53 (on the condition that the shell be made of an electrical insulator). The projection may be formed as a separate part from the core 52, shell 53 and the base plate 51, to either one of which it is secured by suitable means.

A specific embodiment of degreasing a can according to the method of this invention is described below. First, a D&I tinplate can having a lubricant film formed thereon was placed in the cavity 65 as shown in FIG. 1, and was treated by the following procedure:

(1) preliminary degreasing wherein aqueous methylene chloride (ca. 40° C.) was let flow between the inner surface of the can and the outer surface of the core and between the outer surface of the can and the inner surface of the shell for about one second;

(2) discharging the methylene chloride used in the preliminary degreasing, followed by main degreasing wherein aqueous methylene chloride (ca. 40° C.) purified by distillation was let flow likewise between the inner surface of the can and the outer surface of the core and between the outer surface of the can and the inner surface of the shell for about one second;

(3) discharging the methylene chloride used in the main degreasing, followed by vapor degreasing wherein heated methylene chloride vapor was likewise let flow between the inner surface of the can and the outer surface of the core and between the outer surface of the can and the inner surface of the shell for about one second;

(4) discharging the methylene chloride vapor, followed by removal of the residual methylene chloride through evaporation in the cavity that was kept in a vacuum for about one second; and (5) blowing compressed air (ca. 5 kg/cm$^2$) into the gap between the inner surface of the can and the outer surface of the core and the gap between the outer surface of the can and the inner surface of the shell for about one second so as to remove any residual methylene chloride from the cavity.

The can was subsequently taken out of the cavity. In the embodiment above, the methylene chloride used in the steps (1), (2), and (3) was recovered by respective recovery means (not shown) and purified by the conventional method for further use. The small amount of rinsing air was also recovered by a recovery means (not shown). As a result, considerable solvent saving was achieved. The solvent is not limited to methylene chloride, and any organic solvent capable of dissolving fats and oils can be used, such as petroleum, gasoline, acetone, ether, trichloroethylene, chloroform, carbon tetrachloride, trichloroethane, perchloroethylene, trichloromonofluoromethane, 1,1,2-trichloro-1,2,2-trifluoroethane and 1,1,2,2-tetrachloro-1,2-difluoroethane, and halogenated hydrocarbon is preferred because of its noninflammability.

We then placed the degreased can in the cavity in the electrolytic apparatus of FIG. 2 and treated it by the following procedure:

(1') letting 2% aqueous sodium bicarbonate (ca. 60° C.) flow between the inner surface of the can and the outer surface of the core and between the outer surface of the can and the inner surface of the shell, and applying a current of 5 amperes at 6 volts for about one second with the can being connected to the negative electrode and the outer surface of the core and the inner surface of the shell being connected to the positive electrode;

(2') discharging the aqueous sodium bichromate while at the same time, compressed air (ca. 5 kg/cm$^2$) was blown into the gap between the inner surface of the can and the outer surface of the core and the gap between the outer surface of the can and the inner surface of the shell for about one second to eliminate and discharge the residual sodium bichromate on the inner and outer surfaces of the can, the outer surface of the core, and the inner surface of the shell;

(3') letting water (ca. 60° C.) flow likewise between the inner surface of the can and the outer surface of the core and between the outer surface of the can and the inner surface of the shell for about two seconds to rinse the respective surfaces;

(4') discharging the water while at the same time, compressed air (ca. 5 kg/cm$^2$) was blown likewise into the gap between the inner surface of the can and the outer surface of the core and the gap between the outer surface of the can and the inner surface of the shell for about one second to eliminate and discharge the residual water on the respective surfaces;

(5') letting deionized water (ca. 60° C.) flow likewise between the inner surface of the can and the outer surface of the core and between the outer surface of the can and the inner surface of the shell for about two seconds to rinse the respective surfaces; and (6') discharging the deionized water while at the same time, compressed air (ca. 5 kg/cm$^2$) was blown likewise into the gap between the inner surface of the can and the outer surface of the core and the gap between the outer surface of the can and the inner surface of the shell for about one second to eliminate and discharge the residual deionized water on the respective surfaces.

To treat a number of cans continuously with the apparatus and method described above, a plurality of units of the apparatus shown in FIGS. 1 and 2 or any similar apparatus are arranged in a ring, and treating fluids are supplied to the respective units in the sequence of the steps (1) thru (5) and (1') thru (6') with the timing of each step being slightly delayed from that of the next step. The cans are continuously supplied to the treating units which are placed in a ring and the treated cans are taken out of these units continuously. The treated cans are subsequently fed to the drying step. Aqueous sodium bichromate was used in the step (1'), but solutions of other bichromates, chromates, chromic acid, phosphates, phosphoric acid, etc. may be used as the electrolyte. Certain electrolytes enable the subsequent step of rinsing with water to be omitted.

The sequence of the steps (1) thru (5) and that of the steps (1') thru (6') took about five and eight seconds per can, respectively. This is a remarkable reduction in the treating period in consideration of the fact that it took about eleven minutes to degrease a can and form a surface having particular properties on it by the conventional method wherein the can was transported on a net conveyor while it was sprayed with the respective treating fluids.

To evaluate the corrosion resistance of the can treated by the method of this invention, we treated the same can by two other methods: one was the method that is most commonly used in the can making industry to treat the surface of cans, wherein the can was transported on a net conveyor with the open end facing down while it was sprayed with an aqueous degreasing agent (10 g/l of sodium phosphate, 3 ml/l of nonionic surfactant, pH: 9.2, temp. = 60° C.), water and a chemical for providing a surface having particular properties (2% sodium bichromate, 75° C., 30 sec.), and this method took about eleven minutes to complete the sequence; and the other method consisted of a degreasing step that was performed as in the method of this invention and a subsequent step of forming a surface having particular properties wherein the can was immersed in aqueous sodium bichromate at 60° C. for 30 seconds, followed by thorough rinsing with water. After drying, the three cans were subjected to (a) a salt spray test for five minutes according to JIS Z 2371 and (b) a warmer test wherein the cans were immersed in water at 60° C. for ten minutes. The results were as follows: (1) The can treated by the method of this invention was the least attacked by corrosion and was evaluated as the best, and (2) next came the can treated by the method currently used by most can manufacturers, and the can that was immersed in aqueous sodium bichromate immediately after degreasing was the most attacked by rust and found to be the worst.

The above test results show that the method of treating the surface of a can according to this invention has the advantages of reduction in the size of treating apparatus, shortened treating period, reduced treating cost, and improved resistance to corrosion.

In the embodiment illustrated above, degreasing with solvent was carried out using the apparatus shown in FIG. 1, but the apparatus for degreasing is not limited to that particular embodiment, and other devices such as spray machine or other methods such as spraying and immersion using a solvent tank or combination thereof may be employed. The apparatus for electrolysis is also not limited to the type shown in FIG. 2, and any other apparatus may be used if it can form a surface having particular properties on a can by electrolysis.

Instead of electrolysis, the degreased can may be subjected to electrophoretic coating wherein the can is placed in the cavity with a current applied to a water-soluble or water-reducible paint that is flowing between the inner surface of the can and the outer surface of the core and between the outer surface of the can and the inner surface of the shell, with the can being connected to the positive electrode and the inner surface of the shell and the outer surface of the core being connected to the negative electrode. The advantage of this electrophoretic coating is that it enables the degreased can to be coated with a water-soluble paint that has been difficult to apply by the conventional method to provide good adhesion.

A D&I tinplate can was used in the embodiment above, but other can materials may be used, such as aluminum plate, chrome-plated steel plate, chemically treated steel plate, black plate and other steel plates. Cans other than D&I cans may also be used, such as a drawn (D) can, and a drawn, redrawn and ironed (D&RD) can. The inner and outer surface of the can may be subjected to different treatments.

As described in the foregoing, this invention can treat the surface of a can at high speed, and hence contributes greatly to increased can production speed and reduced production cost, as well as improved resistance to corrosion.

What is claimed is:

1. A method of treating a surface of a seamless container made of a member selected from te group consisting of steel and aluminum, which comprises:

causing an organic solvent to flow along and on said surface to degrease said surface, blowing compressed air on said degreased surface to remove said organic solvent from said degreased surface, and subjecting the resultant surface to (1) electrolysis in an aqueous electrolytic fluid or (2) electrophoretic coating in an aqueous electrophoretic fluid.

2. A method according to claim 1 wherein the organic solvent is aqueous methylene chloride.

3. A method according to claim 1 wherein the electrolysis is performed with an electrolyte made of 2% sodium bichromate.

* * * * *